US006848932B2

(12) United States Patent
Bowling et al.

(10) Patent No.: US 6,848,932 B2
(45) Date of Patent: Feb. 1, 2005

(54) WAFER CONNECTOR LATCHING ASSEMBLY

(75) Inventors: Paul Bowling, Little Rock, AR (US); Keith Lloyd, Maumelle, AR (US); Michael F. Magajne, Cicero, IL (US); Kent E. Regnier, Lombard, IL (US); Ed Seamands, Little Rock, AR (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/061,707

(22) Filed: Jan. 31, 2002

(65) Prior Publication Data

US 2002/0072267 A1 Jun. 13, 2002

Related U.S. Application Data

(62) Division of application No. 09/575,098, filed on May 19, 2000, now Pat. No. 6,371,788.

(51) Int. Cl.[7] ..... H01R 13/627
(52) U.S. Cl. ..... 439/358; 439/701
(58) Field of Search ..... 439/350, 351, 439/352, 353, 354, 355, 357, 358, 701, 607

(56) References Cited

U.S. PATENT DOCUMENTS 4,615,578 A 10/1986 Stadler et al. ..... 339/143 R
4,718,857 A * 1/1988 Noschese ..... 439/292
4,778,411 A * 10/1988 Rudy, Jr. et al. ..... 439/681
4,787,860 A * 11/1988 Bender ..... 439/358
5,011,425 A * 4/1991 Van Zanten et al. ..... 439/353
5,118,306 A * 6/1992 Bixler et al. ..... 439/405
5,176,538 A 1/1993 Hansell, III et al. ..... 439/607
5,281,161 A * 1/1994 Kanai ..... 439/357
5,860,826 A * 1/1999 Chang ..... 439/358
5,879,194 A * 3/1999 Thenaisie et al. ..... 439/607
5,993,259 A 11/1999 Stokoe et al. ..... 439/608
5,997,361 A * 12/1999 Driscoll et al. ..... 439/701
6,056,578 A * 5/2000 Lin ..... 439/358
6,093,044 A * 7/2000 Arbuckle ..... 439/354
6,120,332 A * 9/2000 Bertens et al. ..... 439/701
6,139,366 A * 10/2000 van Woensel ..... 439/609
6,217,364 B1 * 4/2001 Miskin et al. ..... 439/358

* cited by examiner

*Primary Examiner*—Hien Vu
(74) *Attorney, Agent, or Firm*—Thomas D. Paulius

(57) ABSTRACT

Blocks of wafer or plug connectors are held together by retainer members and are secured within a backplane connector by a latching assembly. The latching assembly includes a latching lever that has an engagement end extending to the base of the backplane connector. The lever is movably connected to the retainer member so that it may pivot, or rock, about an inflection point. The lever also includes a biasing member that constantly biases the lever into a latching position.

10 Claims, 5 Drawing Sheets

WAFER CONNECTOR LATCHING ASSEMBLY

REFERENCE TO RELATED APPLICATIONS

This application is a divisional application or prior application Ser. No. 09/575,098, filed May 19, 2000, now U.S. Pat. No. 6,371,788, issued Apr. 16, 2002.

BACKGROUND OF THE INVENTION

The present invention relates generally to backplane connector assemblies, and more particularly to a latching assembly that holds a series of wafer connectors in place within a backplane connector.

Backplane connectors provide receptacles for circuit boards that receive other connectors. In the field of telecommunications, it is common for such connectors to include thin connectors that receive coaxial wires and provide connections between two to four of the wires to a circuit board. These connectors are thin and are often referred to in the art as "wafer" connectors because of their relative diminutive size. In order to facilitate the assembly of such connectors into a suitable backplane connector, it is desirable to hold the connectors together in the form of a block, or other unit. Retainers and clips have been used in the art to accomplish this end. In some applications, it is also desirable to hold the blocks of wafer connectors together in engagement with the backplane connector. It is desirable to provide such a means to hold the connectors in place in the backplane connector and it is further desirable that such a means be easily manipulated with one hand and actuatable without the need to see the points of engagement.

One such connector latching means is described in U.S. Pat. No. 5,186,645, issued Feb. 16, 1993 to the assignee of the present invention. In this patent, an elongated latching member extends alongside a backplane connector and is attached to the circuit board. This attachment to the circuit board uses valuable space on the circuit board that could otherwise be used for circuitry. Additionally, it has a series of latching arms that partially extend over the receptacle portion of the backplane connector. Consequently, the wafer connectors must be moved about in insertion and withdrawal so that the engagement with the latching arm of the latching member is released. It is difficult to utilize such a latching system in tight spaces and it does not facilitate the one-handed insertion and removal of the connector units.

Another latching system is described in U.S. Pat. No. 5,312,276, issued May 17, 1994 wherein a pin header is provided with a pair of lugs. A latch member is provided that engages a connector unit and which also engages the pin header. The latch member is snapped into engagement with the connector unit. The latch member is a separate element and may be prone to loss and misengagement in tight spaces.

The present invention is directed to a backplane connector latching assembly that overcomes the aforementioned disadvantages.

SUMMARY OF THE INVENTION

It is therefore a general object of the present invention to provide an active latching system that is usable on pin headers and other backplane connectors and which does not consume valuable space on a supporting circuit board.

It is another object of the present invention to provide a latching assembly for use with wafer and backplane connectors having a latch member of a low profile that may be used in high density applications.

A further object of the present invention is to provide a latching assembly for backplane connectors in which the assembly includes a retainer member that engages and holds a plurality of wafer connectors together as a block, a latching member that is movably mounted to the retainer and which has a latching end and an actuating end, the latching member extending over and alongside the sidewalls of the backplane connector, whereby the latching member may be easily manipulated into and out of engagement with the backplane connector.

Still another object of the present invention is to provide a latching assembly for use with a backplane connector that receives a plurality of individual wafer connectors therein, the latching assembly including an elongated latching member having a structure sufficient to be used on as little as two of the wafer connectors, the latching member having means for spacing the latching member from the wafer connectors and for permitting selective movement of the latching member, the latching member further having an engagement end that opposes the base of a backplane connector and an actuating end opposite that of the engagement end, the actuating end being movable in two directions either to engage the latching member with the backplane connector or to disengage the latching member from the backplane member.

Yet another object of the present invention is to provide a latch for use with a plurality of wafer connectors to hold the connectors in place within a backplane connector, the latch having an elongated body with two free ends and a contact portion intermediate the two ends, the contact portion abutting the wafer connectors and defining a fulcrum about which the latch can move in a pivotal motion so as to move the latch into and out of engagement with the backplane connector.

A still further object of the present invention is to provide a connector latching assembly including a plurality of connector bodies that are held together as a unit by one or more retainers that extend lengthwise along the unit of connectors, a latch member having an engagement end and an actuating end that extend vertically alongside the connectors, means for movably connecting the latch to the retainer intermediate the two ends, the engagement end having a hook portion disposed thereon and being engageable with the bottom of the backplane connector, the actuating end being easily manipulatable by a connector installer, the latch member being movable about the connecting means so that a user may selectively manipulate the latch engagement end into and out of engagement with the backplane connector.

Yet a further object of the present invention is to provide an active connector latching assembly for latching a series of wafer connectors in place to a backplane connector, wherein the latching assembly includes a pair of low profile latching levers that are movably attached to a pair of retainers that engage the sides of the connectors. The latching levers including biasing members that bias the levers into an engagement position, and the levers having manipulatable end portions that release the levers from engagement when manipulated by a user.

The present invention accomplishes these objects by way of its novel and unique structure. As demonstrated in one embodiment, the latching assembly includes an elongated latching member that has a length greater than the height of a corresponding stack of wafer connectors. The latching member has a width that matches the width of at least two wafer connectors of the connector stock. The latching member includes a bearing surface that abuts the connector stack.

This bearing surface is pronounced and defines a point about which the latching member selectively rocks or moves under pressure by the installer. The latching assembly also includes means for attaching the latching member to the connectors. This attachment occurs along the bearing surface and enables the latching member to move about its point of attachment.

One end of the latching member is provided with a hook end that is adapted to engage a backplane header. Preferably, this engagement occurs along the underside of the backplane connector. The other end of the latching member includes a manipulatable portion which an installer of the connectors can use to move the hook ends in and out of engagement with the backplane connector. The latching member also includes a biasing member that exerts a biasing force on the lever so as to urge the hook ends toward an engagement position with the backplane connector.

The latching assembly may include a retainer member that engages the wafer connectors and holds them together as a block, or unit, of connectors. This retainer member runs lengthwise of the connectors, and it may have openings formed therein that receive attachment lugs that fit in the openings and attach the latching members to the retainers in a manner so as to permit the latching member to rock or pivot around it. In this embodiment, the latching member bearing surface is provided by a protrusion formed therein that projects toward the retainer member. This protrusion spaces the latching member away from the connectors which enables the rocking movement of the latching member. The protrusion has a low profile so that the latching member is spaced only a short distance apart from the connector block so that the latching assembly may be used on high density circuit board applications.

In another principal aspect of the present invention and as exemplified by a second embodiment thereof, the retainer members may be formed with a raised, curved backbone portion that extends away from the connectors, while the latching member bearing surface is flat. In this embodiment, the latching member attachment means may be formed integrally with the latching member in the form of arms or lugs that are received within openings in the retainers.

In yet another principal aspect of the present invention, the retainer member may include a pair of catches that are spaced apart from each other to define a slot that receives a latching member. The latching member manipulation end is folded back upon itself to provide an activating end that can be actuated by pressing it. A pin is held by the catches to provide a surface to keep the latching member in place.

These and other objects, features and advantages of the present invention will be clearly understood through consideration of the following detailed description.

BRIEF DESCRIPTION OF THE DRAWINGS

In the course of the following detailed description reference will be frequently made to the accompanying drawings in which.

DESCRIPTION OF THE PREFERRED EMBODIMENT

Figure 1:
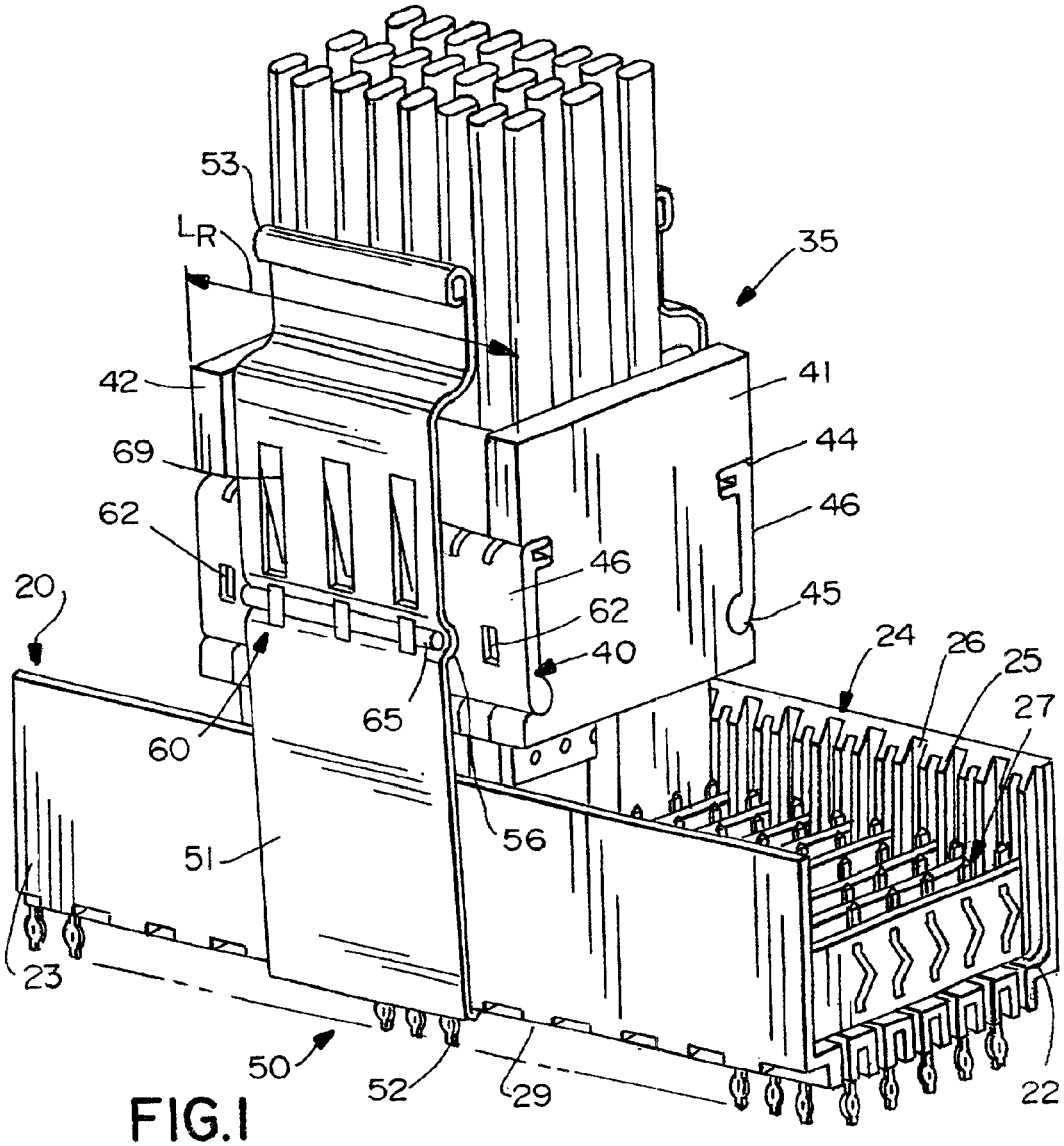
FIG. 1 is a perspective view of a connector latching assembly constructed in accordance with the principles of the present invention in place on a stack of wafer connectors and engaging a backplane connector.

FIG. 1 illustrates a suitable application for the latching assemblies of the present invention. A backplane connector 20 is illustrated as having a generally channel-shaped configuration, with a base portion 22 and a pair to upstanding sidewalls 23, 24. The sidewalls 23, 24 may include a series of ribs 25 that define slots 26 therebetween which may receive opposing alignment ribs 25 (FIG. 5) that are formed on the connectors 30.

Figure 2:
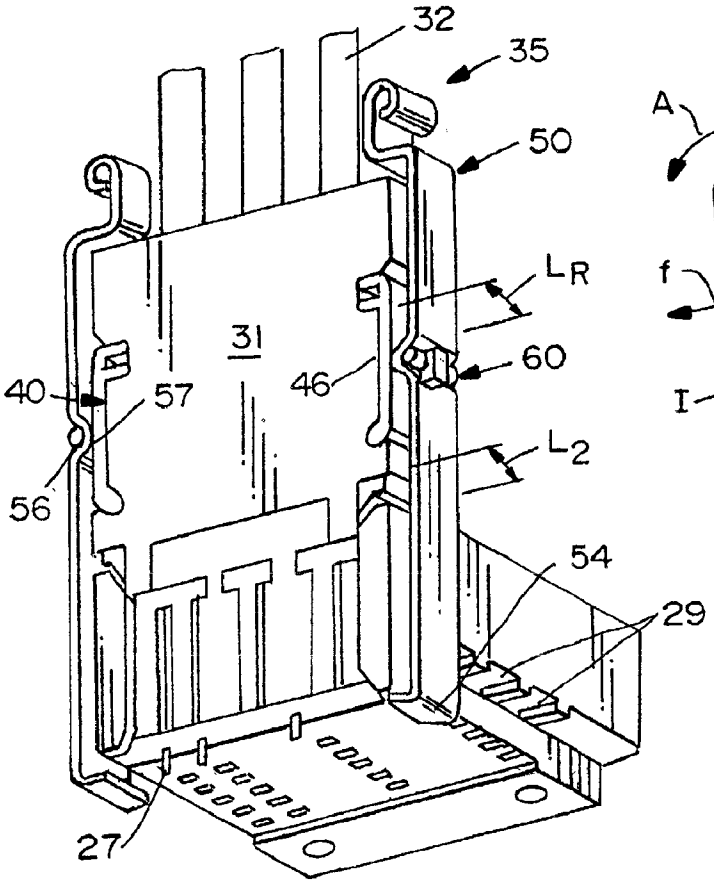
FIG. 2 is a perspective view of the underside of a stack of two wafer connectors engaged with a backplane connector with a reduced-size version of the connector latching assembly of FIG. 1.

The backplane connector 20 provides a means of connecting a series of connectors 30, shown as wafer connectors, to a circuit board (not shown), and therefore is provided with a plurality of conductive pins 27 therein. Hence, the backplane connector 20 may be referred to as a pin header. Each connector 30 has a relatively thin body portion 31 (FIGS. 2–4) into which wires 32 enter and are terminated to either conductive terminals or shields (not shown) that are accessible to the pins 27 of the backplane connector 20. Accordingly, the connecting ends 33 of the connectors 30 are provided with openings 34 (FIG. 5) that define passages in which the pins 27 are received when the connectors 30 are inserted into the backplane connector 20.

In order to facilitate the installation and removal of these connectors, it is desirable to hold them together as a block 35, unit or stack of connectors. To achieve this goal, one or more retainer members or connector stiffeners 40 may be provided. The structure and operation of such a retainer is described in detail in U.S. patent application Ser. No. 09/515,133, filed Feb. 29, 2000, and owned by the assignee of the present invention. The disclosure of this patent application is incorporated herein by reference.

Generally, each retainer member 40 has a length $L_R$ that is approximately equal to the length of the connector block. (FIG. 1.), it being understood that the connector block 35, as illustrated in FIG. 1 may include a pair of endcaps 41, 42 that may will serve as spacers between adjoining blocks of connectors 30. The retainer members 40 have two ends 44, 45 that are interconnected by a backbone or body portion 46. The ends 44, 45, as explained in the aforementioned Ser. No. 09/515,133 application, serve to connect the retainer member 40 to the individual connectors 30 and hold them together as a block or unit of connectors as shown in the drawings. The retainer member 40 therefore has a length that matches that of the connector block 35 and in instances such as that shown in FIG. 1 may have a length $L_R$ that encompasses the connectors and as the endcaps 41, 42, or it may have a length $L_2$ that is just about equal to the length of the connectors 30 that make up the connector block 35, such as the two connectors depicted in FIG. 2.

As mentioned above, the present invention is directed toward a latching assembly that is easy to use and which reliably retains the block of connectors 30 in place within the backplane connector 20. As shown in FIG. 1, one embodiment of the latching assembly includes a latching member 50 in having an elongated body portion that defines a lever 51. This latching lever 51 has two opposing ends, 52, 53. One of the ends 52 acts as a latching end of the lever 51 and has an engagement portion formed thereon that is illustrated as a hook 54. The other end 53 acts as an actuating end that is manipulatable by a user, or installer of the connectors 30 to move the latching lever 51 into and out of engagement with the backplane connector 20. This actuating end 53 may include gripping portions 55 to accommodate the installer's fingers.

The latching lever 51 is intended to move, or rock, in place around a fixed point I, referred to herein as an inflection point. This movement is generally characterized as a rocking movement and may in some instances be a pivoting movement. This movement is shown best in FIGS. 3 and 4 which respectively illustrate the latching lever 51 in a latched (or engaged) position and an unlatched (or disengaged) position. In the latched position, it can be seen that the hook ends 54 engage the backplane connector base 22. The backplane connector base 22 may or may not include channels, or slots, 29 formed therein that are adapted to receive the hook ends 54. In order to accommodate this latching movement, the latching lever 51 of this first embodiment includes a protrusion 56 formed thereon that preferably includes a curved contact surface 57 that faces the retainer member 40. The latching lever 51 rocks on this contact, or bearing, surface 57 in its movement between the two operative positions illustrated in FIGS. 3 and 4.

Figure 11:
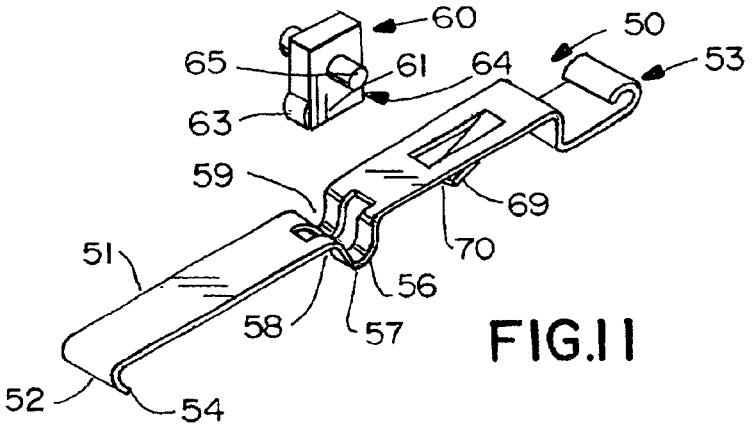
FIG. 11 is an exploded view of the latching assembly of FIG. 1.

The latching assembly also includes a means for attaching the latching lever 51 to the connector block. This attachment means in the first embodiment may take the form of a clip 60 as illustrated best in FIGS. 1, 2 and 11. As shown in FIG. 11, this clip 60 includes an engagement lug 61 that extends through an opening 58 formed in the latching lever 51 at the inflection point I and is received within a similar opening 62 that is formed in the retainer member 40. The lug 61 may have an enlarged portion 63 at its engagement end 64 to retain it in the retainer opening 62. The retainer member 40 may have a series of such openings 62 formed in it along its length that receive corresponding individual clips 60 as shown in FIG. 1.

The latching lever 51 has a hollow depression 59 formed thereon in the exterior surface of the lever 51 in alignment with the protrusion 56. This depression 59 partially holds the clip 60 in that it preferably receives a pin member 65 of the clip 60 that extends lengthwise alongside of the connector block. As shown in FIG. 11, the pin 65 is received within the depression 59 of the latching lever 51 and provides a rotational guide that guides and permits the desirable rocking movement of the lever 51.

Figure 3:
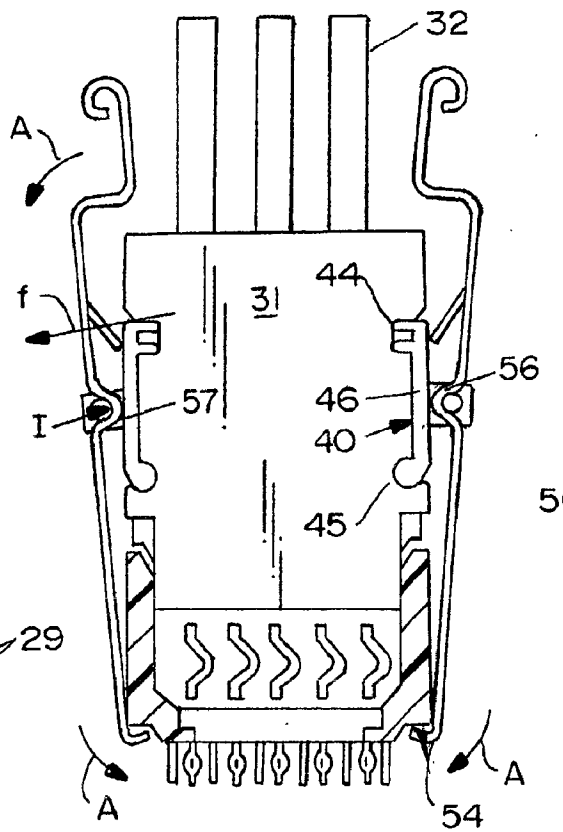
FIG. 3 is a sectional view illustrating the manner of engagement between the latching assembly and the backplane connector with the latching assembly illustrated in a latching position.

In order to bias the latching lever 51 into one of its two operative positions, the latching lever 51 may include a biasing member, shown in FIGS. 1–4 and 11 as a biasing arm 69, that may be formed integrally with the lever 51. This lever 69 extends from the lever 51 toward the connector block 35. It extends in an angled, cantilevered fashion and has a free end 70 that bears against either the connector block 35 or the retainer member 40. As shown in FIG. 3, this biasing arm is located above the inflection point I and therefore exerts an outward force F on the latching lever 51. However because the lever 51 is connected to the connector block 35 at the retainer member 40 by way of the clip 60, the entire lever 51 is restrained from moving apart from the connector block 35. Rather, the clip pin 65 and the lever contact surface 57 cooperate to permit the lever to partially rotate, counterclockwise in FIG. 3, as shown by the arrows A in a manner so as to bias the hook ends 54 of the lever 51 into engagement with the backplane connector base 22. The direction and result of this biasing is shown by the arrows A in FIG. 3.

Figure 4:
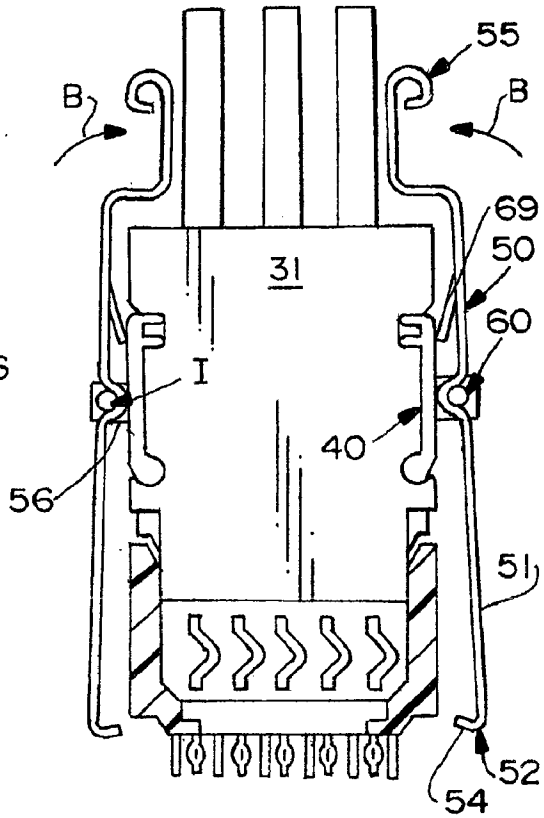
FIG. 4 is the same view as FIG. 3, but illustrating the latching assembly in an unlatched position.

In order to counteract this biasing force, the installer may apply an inward force, represented by the arrows B in FIG. 4. The application of this force will cause the levers 51 to rotate clockwise to disengage the hook ends 54 from the backplane connector base 22. Once removed, the biasing arms 69 will cause the levers 51 to rotate inwardly again. Thus it will be appreciated that the biasing arms 69 serve to maintain the levers 51 in a latched position so that the installer need not be concerned about a proper engagement. Additionally, the hook ends 54 may slide along the exterior surfaces of the backplane sidewalls 23, 24 during insertion of the connector block 35 into the connector 20. The biasing force exerted on the lever 51 will cause the hook ends 54 to snap into engagement with a slot 29 formed in the bottom surface of the connector base 22.

Figure 5:
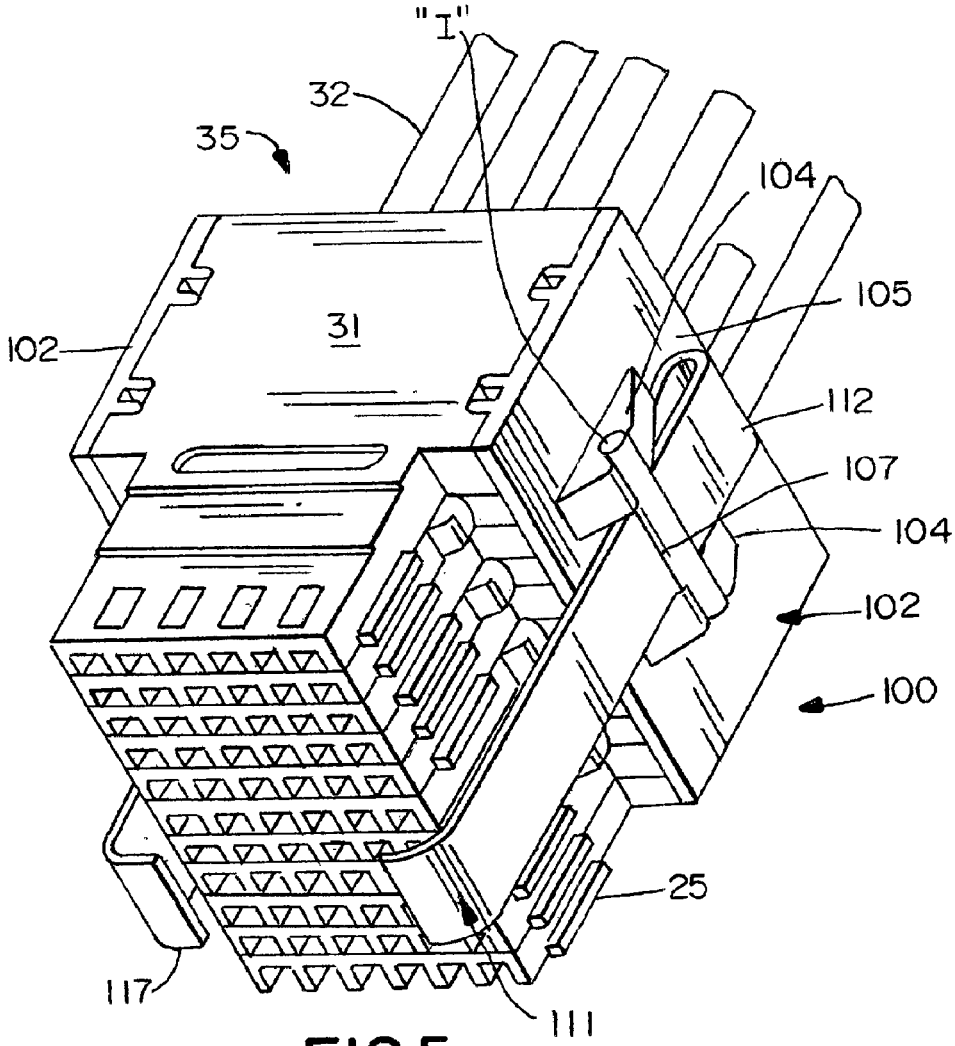
FIG. 5 is a perspective view taken from the underside of a group of connectors, illustrating a second embodiment of a connector latching assembly constructed in accordance with the principles of the present invention in place on a stack of connectors.
Figure 6:
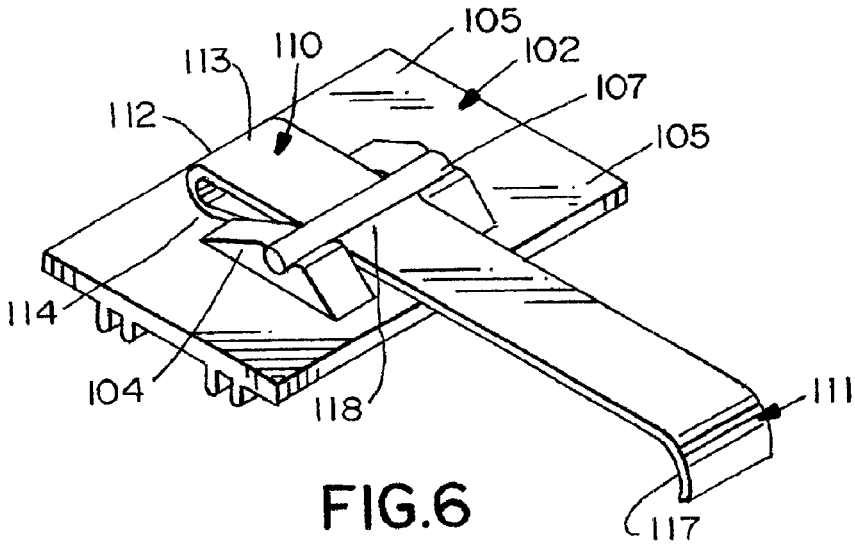
FIG. 6 is a perspective view of the latching assembly of FIG. 5.
Figure 7:
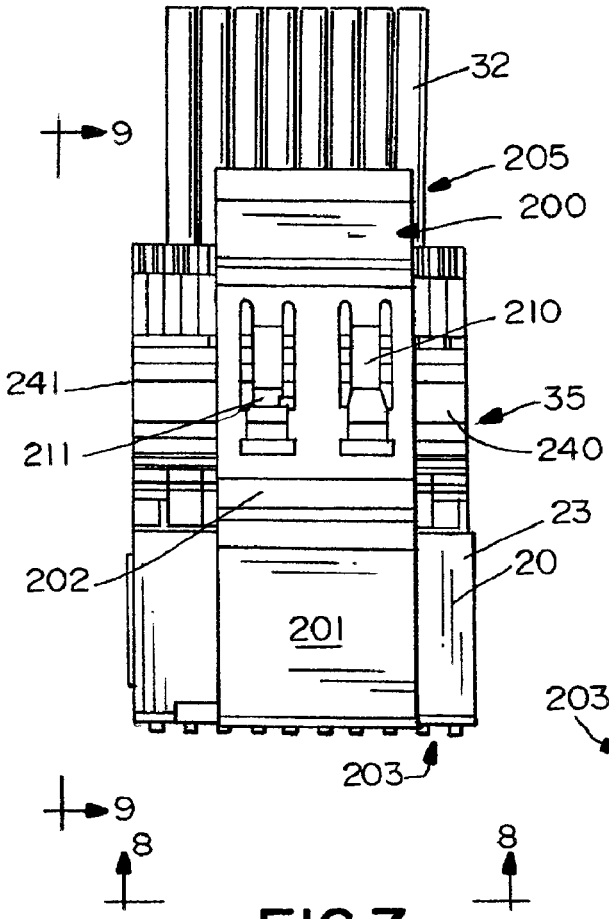
FIG. 7 is a side elevational view of a third embodiment of a latching assembly constructed in accordance with the principles of the present invention in place upon a stack of connectors and holding them in place with a backplane connector.
Figure 8:
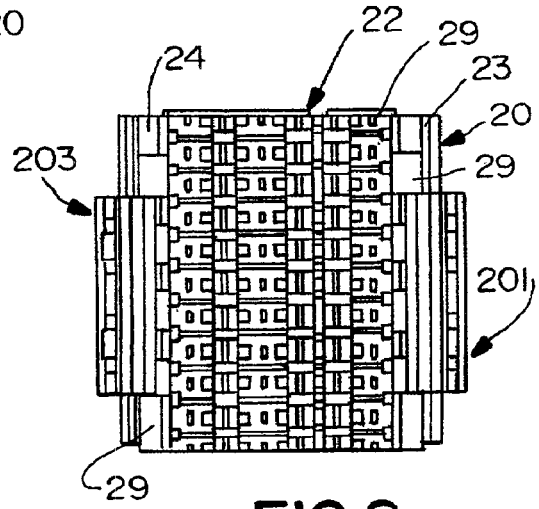
FIG. 8 is a bottom plan view of the connector assembly of FIG. 7 taken from along lines 8—8 thereof.
Figure 9:
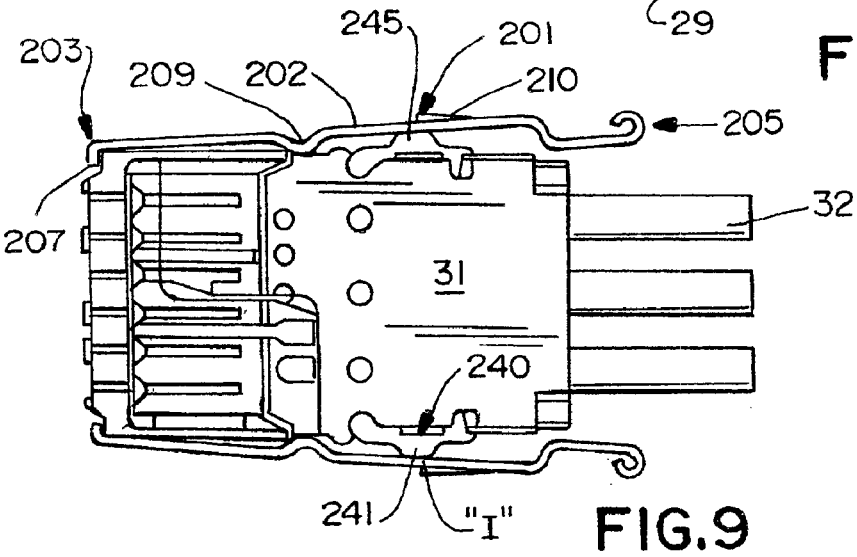
FIG. 9 is an end view of the connector assembly of FIG. 7 taken along lines 9—9 thereof.
Figure 10:
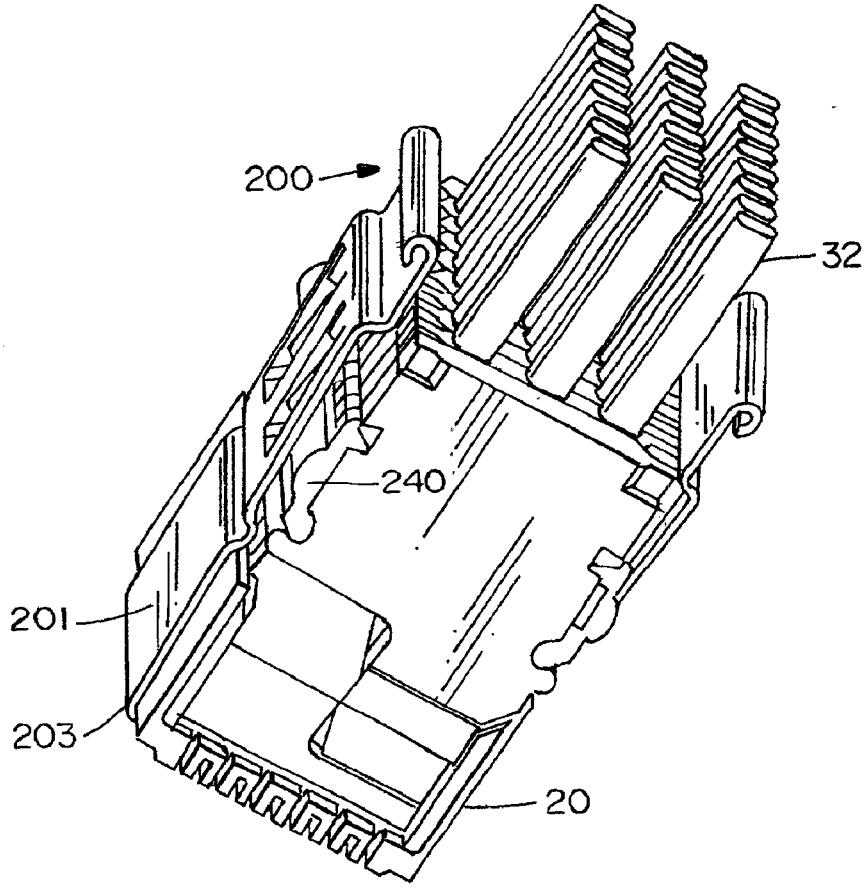
FIG. 10 is a perspective view of the connector assembly of FIG. 7.
Figure 12:
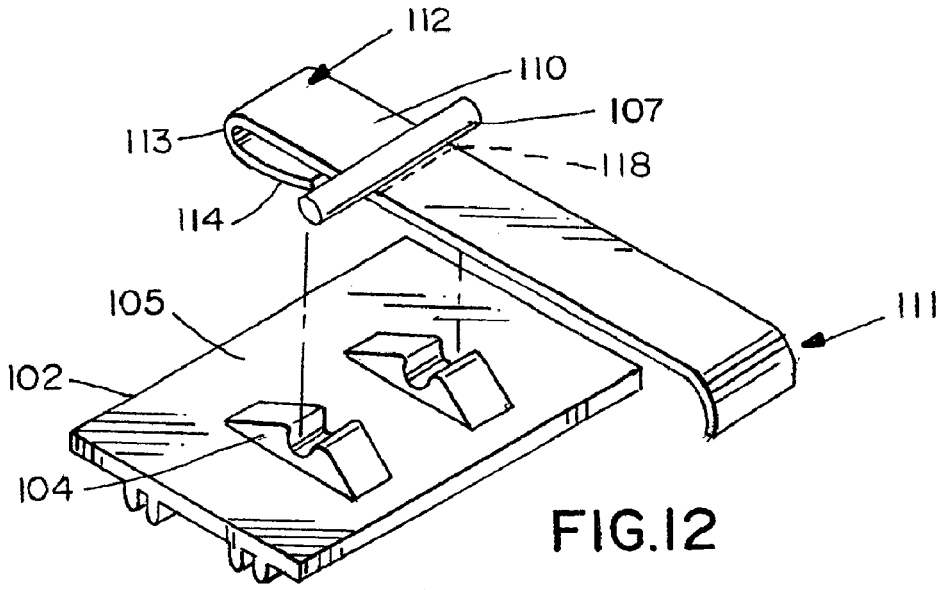
FIG. 12 is an exploded view of the latching assembly of FIG. 5.

FIGS. 5 and 12 illustrate a second embodiment of a latching assembly 100 constructed in accordance with the principles of the present invention. In this latching assembly 100, the retainer member 102 is much larger than the one of FIGS. 1–4 and it has a pair of support blocks 104 formed therewith. The latching lever 110 is much simpler having a lower hook end 111 and an upper biasing end 112. This biasing end 112 is formed by way of a flexible end 113 that is bent upon itself so that a free end 114 thereof abuttingly contacts the outer surface 105 of the retainer 102.

The support blocks 104 are spaced apart from each other a distance sufficient to accommodate the latching lever 110 therebetween. A pin 107 is provided and may be held in the support blocks 104 in the manner shown to restrain the latching lever 110 to partial pivotal or rocking movement. The pin 107 may also be formed as part of the latching lever 110 as well. In instances where the pin 107 is separate, the latching lever 110 may include a recess 118 that extends transversely thereacross in order to locate the lever 110 at a predetermined location with respect to the engagement end 117 of the lever 110.

FIGS. 7–10 illustrate another embodiment 200 of the latching assembly constructed in accordance with the principles of the present invention. In this embodiment, the latching lever 201 is slightly modified in that it has no protrusion comparable to that in the first embodiment. In this embodiment, the retainer member 240 has a protrusion, or projection 241 that in effect serves as a fulcrum about which the lever 201 may move. This projection 241 also serves to space the lever 201 away from the sides of the connector block 35.

The lever 201 has an elongated body portion 202 with opposing engagement ends 203 and actuating ends 205. The actuating ends 205 have gripping portions 206 on them, while the engagement ends 203 may include hook portions 207 that are adapted to engage channels 29 formed in the base 22 of the backplane connector 20. The lever 201 may also include a stop portion 209 that projects toward the connector block 35 that will limit the inward movement. The stop portion 209 is disposed between the point of connection between (and inflection) I of the lever 201 and the connector block 35.

These type levers 201 have their biasing portion integrated into their structure in the form of an attachment leg 210 that extends inwardly therefrom in a cantilevered fashion. This leg 210 has a free end 211 that is received within an opening 242 formed in the body of the retainer 240. This leg 210 preferably diverges at an angle from the body of the lever 201 directed toward the connector block 35 and the connection end thereof. The leg free end 211 is inserted into the retainer opening and the angle of the leg imparts an inward, or counter-clockwise bias to the lever 201 forcing the two levers 201 on a connector block 35 toward each other and toward the center of the backplane connectors 20 to thereby engage the backplane connector 20 along its base portion 22.

Thus, the biasing elements of the latching lever 201 continuously bias the engagement ends 203 into an engagement position. In order to disengage the latching lever 201 from the backplane connector 20, a user need only exert pressure in a direction opposite that of the biasing elements, or inwardly to thereby rotate the latching levers 201 around the exterior bearing surface 245 of the retainer projections 241. It can be seen that such a structure is a user-friendly "active" latch, i.e., the latching levers are always biased into positions.

The latching levers of the present invention also have a thin and low profile in that they do not project excessively from the connector block so that the latching assembly may be easily used in high density circuit board applications. Additionally, because the latching levers are attached to the connector block 35 along the retainers thereof, it does not require any modification to the body portions of the wafer connectors. Furthermore, it may be used on as few as two connectors.

While the preferred embodiment of the invention have been shown and described, it will be apparent to those skilled in the art that changes and modifications may be made therein without departing from the spirit of the invention, the scope of which is defined by the appended claims.

We claim:

1. A latching assembly for securing a plurality of connector modules to a mating connector in mating engagement, comprising:

at least one retainer member for connecting to the plurality of connector modules and holding said connector modules together in a group of connector modules, the retainer member connecting to said connector modules only along a common side thereof and not providing a housing around said plurality of connector modules;

a latching lever including an elongated body portion extending between first and second opposing free ends, the latching lever first end defining a latching end for engaging the mating connector when said connector modules are mated to said mating connector, and the latching lever second end defining an activating end that is manipulatable by a user to urge said latching lever first end into and out of engagement with said mating connector;

means for movably mounting said latching lever on said plurality of connector modules at a point of inflection intermediate said first and second ends thereof, the movable mounting means being integrally formed with said latching lever; and, a biasing member formed as part of said latching lever for applying a biasing force to said latching lever to urge said latching lever into an engagement position.

2. The latching assembly of claim 1, wherein said retainer member has a raised projection that said latching lever contacts.

3. The latching assembly of claim 2, wherein said latching lever is spaced apart from said plurality of connectors and said retainer member by said raised projection.

4. The latching assembly of claim 1, wherein said latching lever second end includes a free end folded upon itself such that the folded free end contacts said retainer member, said folded free end defining said biasing member.

5. The latching assembly of claim 1, wherein said biasing member includes an arm portion that is formed as part of said latching lever and which extends at an angle away from said latching lever.

6. The latching assembly of claim 1, wherein said latching lever biasing member is positioned between said moveable mounting means and said latching lever second end.

7. The latching assembly of claim 1, wherein said moveable mounting means includes at least one post formed with and extending from said latching lever between said first and second ends thereof, said post providing the point of inflection about which said latching lever rotates.

8. The latching assembly of claim 7, wherein said moveable mounting means includes a pair of posts formed as part of said latching lever and extending from said latching lever at a location between said first and second ends thereof, said posts cooperatively defining said point of inflection about which said latching lever rotates.

9. A latching assembly for securing a plurality of connector modules to a mating connector in mating engagement, comprising:

retaining means for connecting to said plurality of connector modules only along a common side thereof and not providing a housing around said plurality of connector modules and retaining said connector modules together in a group of connector modules, the group of connector modules including mating face for mating with the mating connector, a cable face wherein cables terminated to said connector modules extend therefrom, and four distinct sides;

a latching lever including an elongated body portion extending between first and second opposing ends, the latching lever first end defining a latching end for engaging said mating connector, the latching lever second end defining an activating end that is manipulatable by a user to urge said latching lever first end into and out of engagement with said mating connector; and, means for mounting said latching lever to at least one side of said group of connector modules, the latching lever mounting means being formed integrally with said latching lever and permitting rotational movement of said latching lever about a point of inflection intermediate said latching lever first and second ends, and said latching lever further including a biasing member formed therewith for applying a biasing force to said latching lever to bias said latching lever into an engagement position.

10. The latching assembly of claim 9, wherein said biasing member applies the biasing force to said latching lever at a location intermediate said latching lever point of inflection and said second end.

* * * * *